United States Patent [19]

Davis et al.

[11] 4,116,816

[45] Sep. 26, 1978

[54] PARALLEL HYDRODESULFURIZATION OF NAPHTHA AND DISTILLATE STREAMS WITH PASSAGE OF DISTILLATE OVERHEAD AS REFLUX TO THE NAPHTHA DISTILLATION ZONE

[75] Inventors: Edgar D. Davis; Gilbert L. Colbert, both of Borger, Tex.

[73] Assignee: Phillips Petroleum Company, Bartlesville, Okla.

[21] Appl. No.: 773,236

[22] Filed: Mar. 1, 1977

[51] Int. Cl.[2] ..... C10G 23/00

[52] U.S. Cl. ..... 208/209; 208/218; 208/364

[58] Field of Search ..... 208/209, 210, 212, 211, 208/216, 354

[56] References Cited

U.S. PATENT DOCUMENTS

| | | | |
|---|---|---|---|
| 2,866,750 | 12/1958 | Mosesman | 208/216 |
| 2,897,141 | 7/1959 | Honeycutt et al. | 208/209 |
| 2,953,521 | 9/1960 | Bowles | 208/212 |
| 3,077,448 | 2/1963 | Kardash et al. | 208/216 |

*Primary Examiner*—George Crasanakis

[57] ABSTRACT

In a hydrodesulfurization process having separate naphtha and distillate hydrodesulfurization zones, volatile fractions of the distillate hydrodesulfurization effluent are recycled to the naphtha feed stream before it combines with the hydrogen stream and enters the hydrodesulfurization zone and heavy fractions separated from the naphtha hydrodesulfurization effluent are combined with a diesel fuel oil fraction separated from the distillate hydrodesulfurization effluent. Alternatively, light fractions separated from the distillate hydrodesulfurization effluent are combined with a condensed liquid stream being returned to a distillation fractionation zone separating light fractions from the naphtha hydrodesulfurization effluent.

1 Claim, 2 Drawing Figures

PARALLEL HYDRODESULFURIZATION OF NAPHTHA AND DISTILLATE STREAMS WITH PASSAGE OF DISTILLATE OVERHEAD AS REFLUX TO THE NAPHTHA DISTILLATION ZONE

BACKGROUND OF THE INVENTION

This invention relates to the removal of sulfur and sulfur compounds from hydrocarbon streams. In particular, it relates to an improved process for hydrodesulfurization of two dissimilar hydrocarbon streams in separate reaction zones which are arranged in parallel.

In an effort to preserve and improve the quality of the environment, hydrocarbon streams obtained by fractional distillation of crude oils are further treated to remove most of the sulfur contained therein by a process such as hydrodesulfurization. With the increasing costs of crude oil and of energy it is essential that processes for making specific hydrodesulfurization hydrocarbon materials, not only produce the highest possible yields of hydrocarbon materials complying with the usual specifications, but also that these processes be energy efficient.

The present invention provides an improved process for the production of desulfurized hydrocarbon fractions from naphtha and distillate hydrocarbon streams.

Thus, one object of the invention is to provide an improved process for separate hydrodesulfurization of naphtha and distillate hydrocarbon streams.

Another object of the invention is to provide a hydrodesulfurization process for treating two dissimilar hydrocarbon streams which are energy efficient.

A further object of the invention is to provide a hydrodesulfurization process which results in high yield of products complying with usual specifications.

Still another object of the invention is to provide a hydrodesulfurization process which results in making products containing greatly reduced amounts of sulfur.

A still further object of the invention is to provide an improved hydrodesulfurization process for making hydrocarbon fractions capable of meeting environmental standards.

Other objects of the invention will become apparent to those skilled in the art upon studying this disclosure.

SUMMARY OF THE INVENTION

In accordance with one aspect of the invention, naphtha and distillate streams are passed through separate hydrodesulfurization zones and hydrodesulfurization effluents are passed to fractional distillation zones and therein subjected to such distillation conditions as to separate each of the effluents into an overhead, intermediate, and bottoms fractions. A portion of the overhead recovered from the distillate hydrodesulfurization is recycled to the naphtha feed stream at a point before said stream is subjected to any treatment. The bottoms product obtained from the distillate hydrodesulfurization effluent is combined with a bottoms obtained from the naphtha hydrodesulfurization effluent and the combined bottoms streams result in the production of diesel fuel oil which complies with the usual specifications.

In accordance with another aspect of the invention, the naphtha stream, after passing through the hydrodesulfurization zone, is subjected to two stage fractional distillation and separated therein into a first overhead and a first bottoms fraction, said first overhead being passed to a second fractionation zone and therein separated into a second overhead and a second bottoms product. A portion of the second overhead is withdrawn as product and a portion is returned as reflux and the first bottoms product is combined with the diesel fuel oil fraction or bottoms fraction separated from the distillate hydrodesulfurization effluent. The distillate overhead from the second fractionation zone, or a part of the distillate overhead, is combined with the reflux portion of the second overhead.

Other aspects of the invention will become apparent to those skilled in the art upon studying this disclosure and the appended claims.

DETAILED DESCRIPTION OF THE INVENTION

The improved hydrodesulfurization process of this invention will be described with reference to the specific embodiments depicted in FIGS. 1 and 2. The term "naphtha" throughout this specification means a hydrocarbon stream having a boiling point range from about 160° F (71° C) to about 480° F (249° C). Similarly, the term "distillate" means a hydrocarbon stream having a boiling point ranging from about 300° F (149° C) to about 620° F (327° C). The hydrodesulfurization steps included in the process are conventional and are described, for example, in U.S. Pat. Nos. 3,172,843 and 3,077,448. The conditions employed therein depend largely on the amount of sulfur that can be tolerated in the final products and on the specific catalysts. In the preferred embodiment, depicted in the FIGURES, the conditions in the hydrodesulfurization zones are as follows: zone 35 - pressure 400 psig; temperature 625° F (330° C), and 340 SCF of $H_2$/barrel; zone 235 - pressure 300 psig; temperature 650° F (343° C), and 300–500 SCF $H_2$/barrel.

Figure 1:
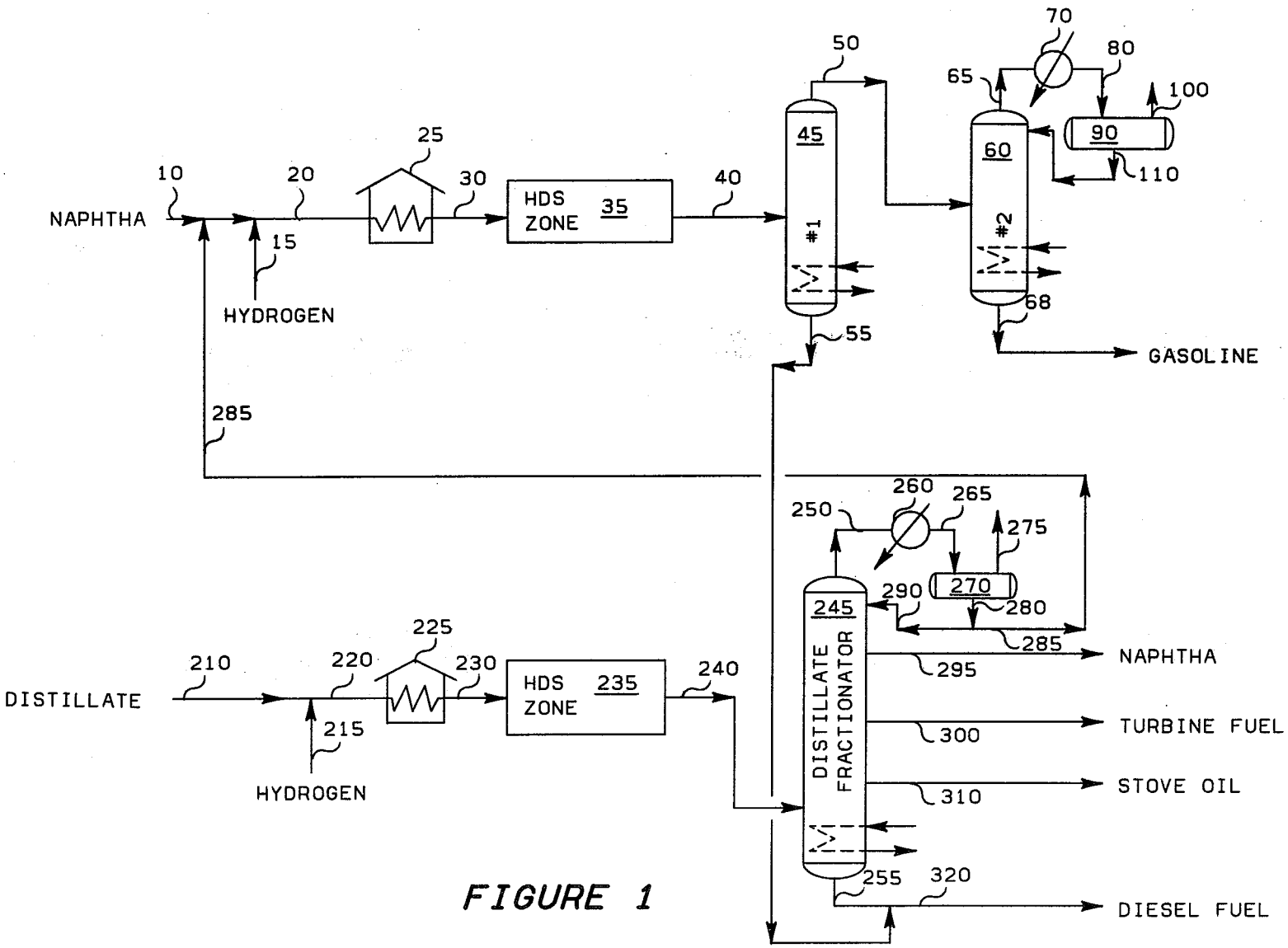
FIG. 1 depicts an embodiment of the hydrodesulfurization process of the present invention wherein a part of the condensed overhead separated from the distillate hydrodesulfurization effluent is combined with the naphtha feed stream, and wherein a bottoms fraction separated from the naphtha hydrodesulfurization effluent is combined with the diesel fuel oil fraction separated from the distillate hydrodesulfurization effluent.

Referring now to FIG. 1, naphtha feed stream 10 is combined with stream 285, subsequently described, and with hydrogen supplied via 15 and the mixed feed is passed by 20 to furnace 25 wherein it is heated to a temperature between 550° F (288° C) and 675° F (357° C). The heated naphtha feed stream containing hydrogen is then passed by line 30 to hydrodesulfurization zone 35 wherein the feed is subjected to hydrodesulfurization conditions sufficient to remove most of the sulfur and sulfur compounds contained therein. The essentially sulfur-free naphtha stream is withdrawn from zone 35 by line 40 and passed to fractional distillation column 45. The conditions in fractional distillation column 45 are such as to separate the desulfurized naphtha stream into an overhead stream 50 and a bottoms product stream 55. Overhead stream 50 is passed as feed to fractional distillation column 60 and separated therein into an overhead stream 65 and a bottoms product stream 68. Overhead stream 65 is partially condensed in the cooler 70 and passed by line 80 to accumulator 90. The gases from the accumulator 90 are removed via line 100 and the liquid is passed as reflux via line 110 to the top of the distillation column 60.

A distillate feed stream 210 is passed by line 220 to furnace 225 together with hydrogen introduced via line 215. The distillate feed containing hydrogen is heated to a temperature ranging from about 600° F (316° C) to about 725° F (385° C). The heated distillate feed is passed to line 230 to hydrodesulfurization zone 235 and therein subjected to hydrodesulfurization conditions which result in the removal of substantially all sulfur and sulfur compounds therefrom. The desulfurized distillate stream is withdrawn by line 240 and passed to fractional distillation column 245. The fractional distillation column 245 is operated at such conditions as to separate the desulfurized distillate into an overhead 250, intermediate cuts 295, 300, and 310, and bottoms product 255. Overhead 250 is partially condensed in cooler 260, and then passed by line 265 to accumulator 270. The volatiles are removed from accumulator 270 by line 275 and the liquid condensate is split into streams 285 and 290. Stream 290 is returned as reflux to the top of column 245, whereas stream 285 is combined with naphtha feed stream 10. The intermediate cuts from the distillate fractional distillation column are withdrawn by lines 295 (naphtha yield), 300 (turbine fuel), and 310 (stove oil) and passed to further processing as desired. Bottoms product 225 is combined with the bottoms product 55 from column 45 to produce stream 320 which is useful as diesel fuel oil and in compliance with usual diesel fuel specifications.

Figure 2:
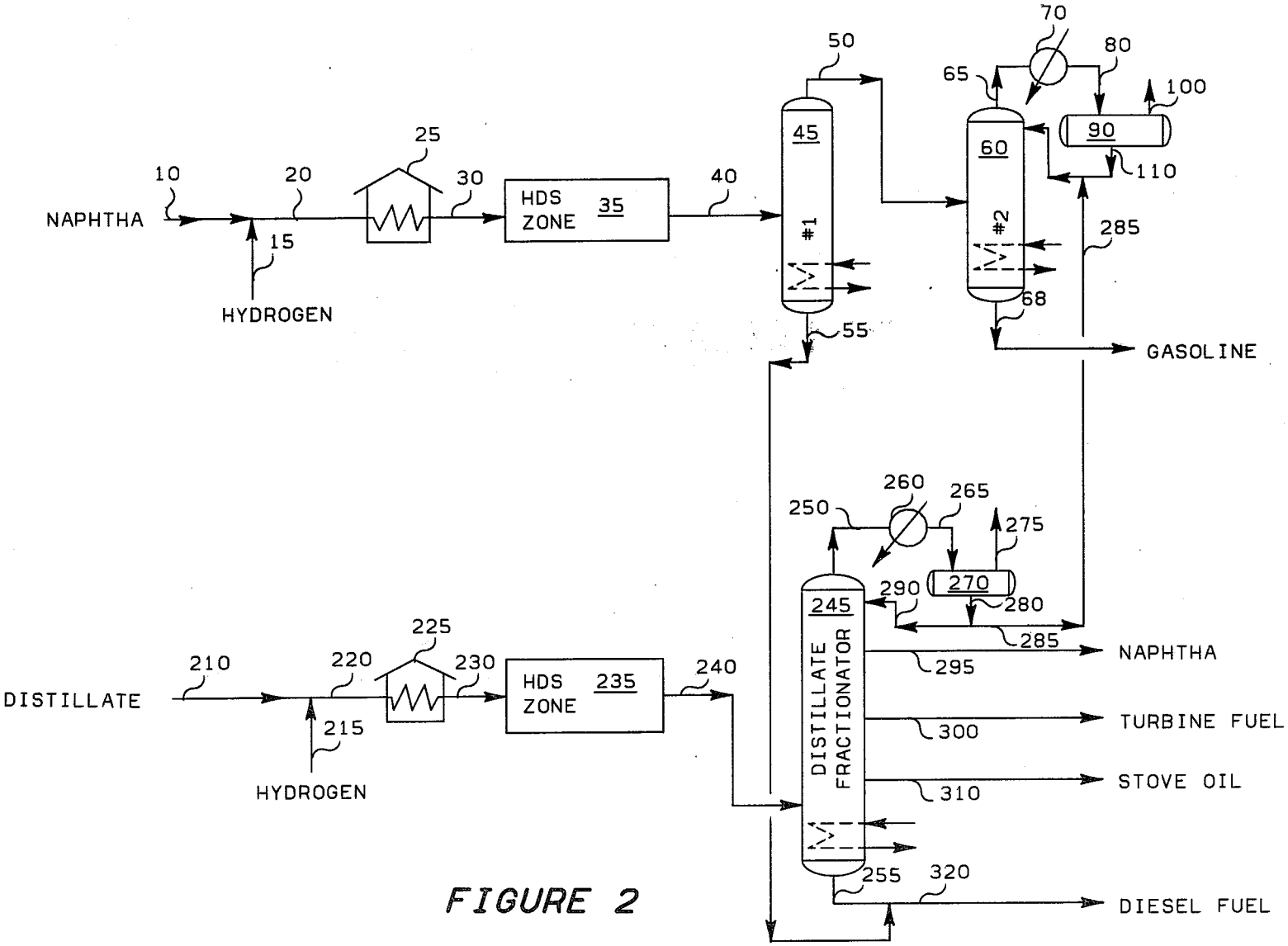
FIG. 2 portrays another embodiment of the process of the present invention which includes passing a portion of the condensed overhead separated from the distillate hydrodesulfurization effluent to the reflux portion of the second fractional distillation zone treating the naphtha hydrodesulfurization effluent. The first bottoms separated from the naphtha hydrodesulfurization effluent are combined with the bottoms separated from the distillate hydrodesulfurization effluent to produce diesel fuel oil complying with the usual specifications.

The process depicted in FIG. 2 is almost identical to that of FIG. 1, except that the recycle line 285 is combined with reflux 110 of naphtha distillation column 60 rather than being combined with naphtha feed stream 10.

Many changes and modifications will become apparent to those skilled in the art upon studying this disclosure. All such changes which are within the spirit of this invention are intended to be included within its scope.

The following examples are presented to further illustrate the practice of the invention and are not intended to limit the scope of the invention in any manner.

EXAMPLE 1

Based on plant runs, the following data have been calculated to compare the prior operation in which bottoms product 55 from the first naphtha fractionator was passed to and combined with the distillate stream 210 before that stream was introduced into the furnace 225 with the operation of the present invention depicted in FIG. 1.

TABLE I

| Stream | Prior Operation | Invention |
|---|---|---|
| (30) Fresh and Recycle Naphtha Feed, B/H | 950 (Larger) | 910 |
| Bottoms from 45 to distillate HDS, B/H | 117 | not done |
| (55) Bottoms to Diesel Fuel Oil 255, B/H | (-) | 100 |
| (230) Total feed to Distillate HDS, B/H | 900 | 783 |

TABLE I-continued

| Stream | Prior Operation | Invention |
|---|---|---|
| | (Larger) | |
| (285) Recycle from column 245 to Fresh Naphtha (10), B/H | 100 (Larger) | 60 |
| (68) Gasoline to Reformer, B/H | 800 | 800 |
| (295) Naphtha Yield, B/H | 96 | 60 |
| (300) Turbine Fuel, B/H | 354 | 315 |
| (310) Stove Oil, B/H | 170 | 158 |
| (320) Diesel Fuel Oil, B/H | 247 | 347 |

The above data in this calculated operation, based on plant runs, charge 100 B/H recycle (285) to naphtha hydrodesulfurization in the prior operation and only 60 B/H in the invention, decreasing the total charge to the naphtha HDS by about four percent; yet both operations yield the same amount of gasoline (85) of 800 B/H for reforming.

The invention can allow about four percent fresh naphtha feed 10 increase (total to 950 B/H) which will increase the gasoline yield 68 by about 38 B/H.

The data also show that the prior operation charges (recycles) 117 B/H of fractionator #1 bottoms (55) to the distillate HDS unit, while the invention charges none of this material thereto. [The invention adds this material to diesel fuel oil (320) directly.]

The invention can allow about fifteen percent fresh distillate feed 210 increase (to about 900 B/H fresh distillate), and increase the yield therefrom.

Charging, as in the example, the same fresh naphtha and the same fresh distillate feed as the prior operation, the invention conserves about 9,000,000 Btu's per hour in the distillate HDS furnace, and about 4,000,000 Btu's per hour in the naphtha HDS furnace (plus a small amount of #1 fractionator reboil duty).

EXAMPLE 2

This example shows the comparison based on calculated data from plant runs of the operation of the process as depicted in FIG. 2, as compared with the operation wherein stream 285 was refluxed back to the top of the column 60 and the prior operation where the bottoms product 55 was combined with the distillate 210 before said distillate entered the furnace 225.

TABLE II

| | Prior Operation | Invention |
|---|---|---|
| (30) Naphtha Feed, B/H | 950 (Larger) | 910 |
| Bottoms from 45 to Dist. HDS, B/H | 117 | not done |
| (55) Bottom to Diesel Fuel Oil 255, B/H | (—) | 100 |
| (230) Total Feed to Dist. HDS, B/H | 900 (Larger) | 783 |
| (285) Overhead 285 to Reflux #2, B/H | 100 (Larger) | 60 |
| (68) Gasoline to Reformer, B/H | 800 | 800 |
| (295) Naphtha Yield, B/H | 96 | 60 |
| (300) Turbine Fuel, B/H | 354 | 315 |
| (310) Stove Oil, B/H | 170 | 158 |
| (320) Diesel Fuel Oil, B/H | 247 | 347 |
| Volume Percent Throughput Increase Gained by Invention | | |
| To Distillate HDS | 10% | |

At the same fresh feed to Naphtha and Distillate HDS units, about 9,000,000 Btu per hour are saved in the distillate HDS furnace, and recycling less #3 fractionator overhead to #2 fractionator saves about 4,000,000 Btu per hour on reboil of fractionator 60.

| Fractionation Operating Conditions in All Runs* | | |
|---|---|---|
| Fractionator 45: | ° F. | ° C. |
| Top temperature | 390 | 199 |
| Bottom temperature | 480 | 249 |
| Pressure, psig | 65 | (449 kPag) |
| Fractionator 60: | | |
| Top temperature | 290 | 143 |
| Bottom temperature | 355 | 180 |
| Pressure, psig | 50 | (345 kPag) |
| Fractionator 245: | | |
| Top temperature | 430 | 221 |
| Bottom temperature | 625 | 330 |
| Pressure, psig | 110 | (759 kPag) |
| Boiling Ranges of Specific Streams | | |
| Stream 55 | 300° F. to 530° F. (149° C. to 277° C.) | |
| Stream 255 | 350° F. to 650° F. (177° C. to 343° C.) | |
| Stream 285 | 215° F. to 400° F. (102° C. to 204° C.) | |
| Stream 320 | 320° F. to 625° F. (160° C. to 330° C.) | |

*These specific temperatures and pressures given above are only illustrative. One versed in hydrocarbon distillation can readily select an operating tower pressure and corresponding temperatures to make the desired products for his specific plant.

We claim:

1. A process for the production of sulfur-free oil fractions from separate naphtha and distillate streams, said process having separate naphtha and distillate hydrodesulfurization steps, which comprises:

(a) passing a preheated naphtha stream comprising hydrocarbons having boiling points between about 160° F (71° C) and about 480° F (249° C), and hydrogen to a hydrodesulfurization zone and therein subjecting said naphtha stream to such hydrodesulfurization conditions as to substantially remove sulfur and sulfur compounds present therein;

(b) passing substantially sulfur-free naphtha stream obtained in (a) to a first fractional distillation zone and subjecting same to such distillation conditions including temperature and pressure as to separate a first naphtha overhead and a first heavy bottoms fraction boiling in the range of about 300–530° F;

(c) withdrawing said naphtha overhead obtained in (b) and passing same to a second fractional distillation zone and therein subjecting the stream to such distillation conditions which result in separation of the stream into a second naphtha overhead and a second bottoms stream comprising gasoline boiling range hydrocarbons;

(d) cooling said second naphtha overhead sufficiently to condense said overhead, and recycling the liquid condensate thus formed as reflux to said second distillation zone;

(e) withdrawing said second bottoms stream as obtained in (c) as product;

(f) passing a preheated distillate stream comprising hydrocarbons having a boiling point range from about 300° F (149° C) to about 620° F (327° C) and hydrogen to a hydrodesulfurization zone maintained at such conditions as to substantially remove sulfur and sulfur compounds therefrom;

(g) passing the substantially sulfur-free distillate stream obtained in (f) to a distillate fractional distillation zone and subjecting said stream to such distillation conditions including temperature and pressure as to separate the stream into a distillate overhead boiling in the range of about 215°–400° F, intermediate cuts, and a heavy distillate bottoms boiling in the range of about 350–650° F;

(h) blending the first heavy bottoms fraction obtained in (b) with the heavy distillate bottoms obtained in (g) as a fuel product boiling in the range of about 320–625° F;

(i) withdrawing the intermediate cuts from step (g) as products, and;

(j) passing a portion of said distillate overhead obtained in step (g) to the liquid condensate reflux stream in (d).

* * * * *